United States Patent [19]

Weyman

[11] 4,276,813

[45] Jul. 7, 1981

[54] PNEUMATIC CYLINDER ASSEMBLIES

[76] Inventor: Henry W. Weyman, Waterworks Rd., Worcester, England

[21] Appl. No.: 915,515

[22] Filed: Jun. 14, 1978

[51] Int. Cl.[3] ..... F15B 15/22

[52] U.S. Cl. ..... 92/12; 92/143

[58] Field of Search ..... 92/11, 12, 8, 143, 9; 137/613

[56] References Cited

U.S. PATENT DOCUMENTS

| | | | |
|---|---|---|---|
| 2,324,515 | 7/1943 | Kalin | 92/12 |
| 2,664,859 | 1/1954 | Green | 92/12 |
| 3,137,369 | 6/1964 | Stromberg | 60/586 |
| 3,146,680 | 9/1964 | Hutter | 92/12 |
| 3,176,801 | 4/1965 | Huff | 92/9 |
| 3,554,221 | 1/1971 | McMurry | 137/613 |
| 3,557,831 | 1/1971 | Katchka | 137/613 |
| 3,890,999 | 6/1975 | Moskow | 137/505.25 |
| 3,979,998 | 9/1976 | Wada | 91/437 |
| 4,147,179 | 4/1979 | Miura | 137/599 |

FOREIGN PATENT DOCUMENTS

| | | | |
|---|---|---|---|
| 2607157 | 8/1977 | Fed. Rep. of Germany | 92/12 |
| 821319 | 10/1959 | United Kingdom | 92/12 |
| 1320335 | 6/1973 | United Kingdom . | |

OTHER PUBLICATIONS

Pneumatic Constructon Units, Konrad Ziesling, Ölhydraulik und Pneumatik 14(1970), No. 7, pp. 295–299.

*Primary Examiner*—Abraham Hershkovitz
*Attorney, Agent, or Firm*—Kenway & Jenney

[57] ABSTRACT

The present invention provides a method and apparatus for controlling the rate of flow of fluid in a high (e.g. 100 kg/sq cm) pressure hydraulic circuit such as is found in pneumatic piston and cylinder arrangements having hydraulic damping and which may be used to control the feed rate of a cutting tool. Control is achieved by incorporating into the fluid circuit, upstream of the flow control orifice, a pressure reducing valve designed to provide a controlled low (e.g. 7 kg/sq cm) pressure independently of changes in applied pressure or demanded flow rates and which further automatically clears itself of any silt deposited thereon from the hydraulic fluid.

3 Claims, 1 Drawing Figure

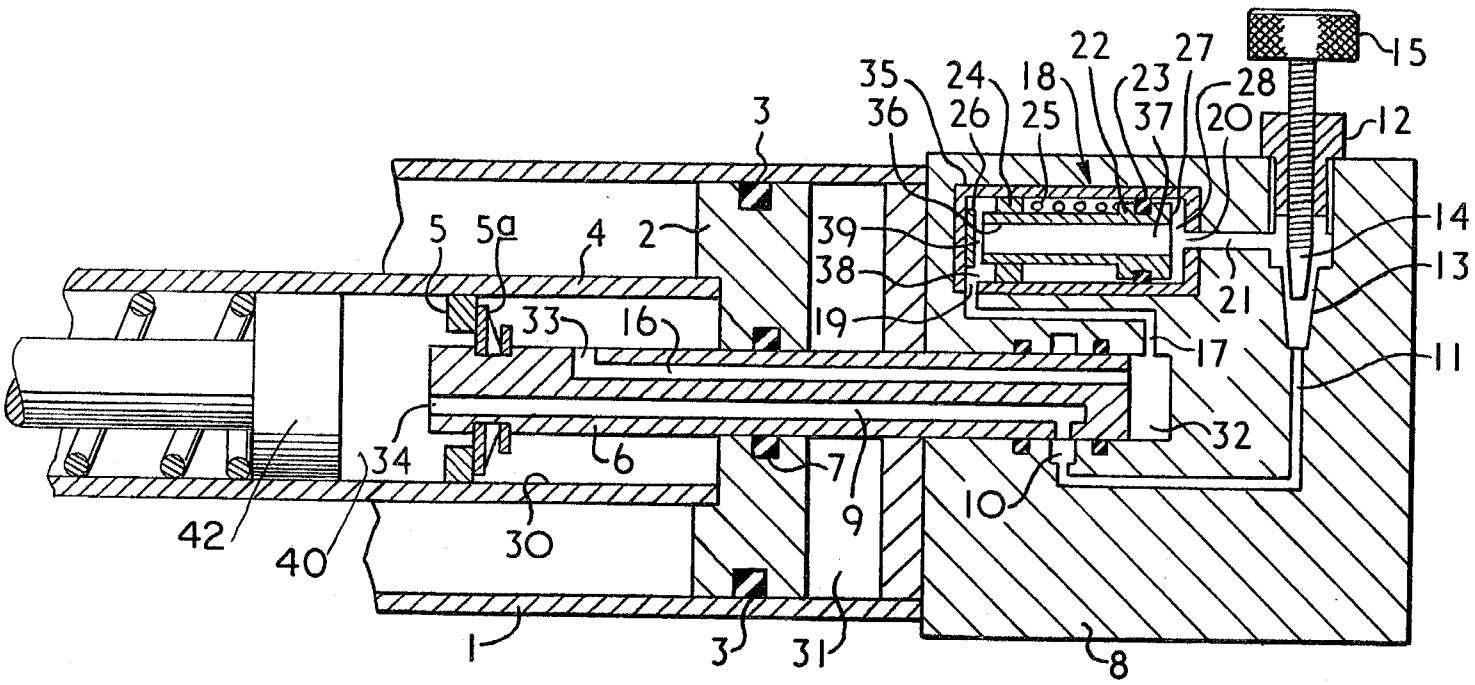
15
12
14
13
11
28
20
21
27
23
37
17
32
22
18
25
8
24
26
10
35
36
39
38
19
7
9
31
3
3
2
16
6
4
33
30
5a
5
34
1
40
42

PNEUMATIC CYLINDER ASSEMBLIES

The present invention relates to a method and apparatus for controlling the rate of flow of fluid in a high pressure hydraulic fluid circuit and is especially concerned with controlling the ram speed of a piston in a pneumatic piston and cylinder assembly incorporating hydraulic damping.

When it is necessary to control the rate of flow of fluid in a hydraulic circuit the fluid is normally caused to pass through an orifice whose size may be varied to regulate the flow rate. A common example is in the use of hydraulic dampng to control ram speed, that is the speed of movement of the piston, of a pneumatic cylinder; this arrangement is necessary because air, being compressible, does not allow control by flow restriction to be applied directly to the pneumatic cylinder. An example of such use is described and illustrated in British Pat. No. 1,320,335. In such applications the operation of the pneumatic cylinder drives the hydraulic cylinder, displacing oil from one side of the hydraulic piston to the other side via an interconnecting circuit. If a metering orifice is located in the circuit to restrict the oil flow, the thrust of the piston in a pneumatic piston and cylinder assembly causes a build up of hydraulic pressure and the resulting rate of flow is dependent upon the size of the orifice and the pressure drop across it. If the orifice size is variable, for example by employing a needle valve, the rate of flow and therefore the ram speed of the pneumatic cylinder may be controlled as required; for example to control the feed rate of a cutting tool.

Since reduction in size normally permits wider use of equipment, the natural development in hydraulic systems is towards a reduction in the size of components. The consequent reduction in the surface areas of the pistons employed in the piston and cylinder assemblies automatically leads to the use of higher hydraulic pressures to operate the required forces, and pressures of the order of 100 kg/sq cm are not uncommon. In order to achieve low flow rates in the hydraulic circuit, and therefore low ram speeds of the pneumatic piston, at these hydraulic pressures, the dimensions of the metering orifice must be reduced to the same order as the size of particles normally present in commercially available fine grades of hydraulic fluids. Under these conditions the particles, which may have a diameter of less than 5 microns, collect at the orifice causing silting and resulting in intermittent and erratic flow rate. Thus the ram speed of the pneumatic cylinder may be caused to slow down progressively along its stroke and there could even be a total loss of pneumatic piston movement. Furthermore with the high pressures applied at the control orifice, control is extremely sensitive and small adjustments of orifice size result in large changes in flow rate.

One objects of the present invention is to provide a pneumatic piston and cylinder arrangement incorporating hydraulic damping in which the hydraulic fluid passes through a flow control valve, in which arrangement the movement of the pneumatic piston can be accurately controlled at slow ram speeds without erratic operation resulting from silting of the flow control valve.

Another object is to provide such an arrangement in which there is reduced sensitivity of control, which reduced sensitivity will allow accurate selection and repeatability of low ram speeds.

A further object is to provide an arrangement in which the speed of the movement of the piston is substantially independent of variations in supply pressure and of working load on the piston; this object is especially relevant when it is necessary to control the speed of the extension and retraction strokes in a double acting pneumatic piston and cylinder arrangement.

A yet further object is to provide an arrangement giving improved consistency of operation under varying air supply and work load conditions.

I have now found that these objects may be achieved by placing a pressure reducing valve, i.e. a low pressure governer, into the hydraulic circuit upstream of the flow control orifice to drop the pressure to a controlled low pressure, typically about 7 kg/sq cm. When low pressures of this order are applied to the flow control orifice, the low flow rates required to produce low ram speeds are obtained at orifice openings wide enough to avoid the danger of silting and the control responses also less sensitive to adjustments of orifice size. Thus the incorporation of a low pressure governer enables low flow rates to be selected, maintained consistently and fine adjustments to flow rates made without the need for minute adjustments of orifice settings. It is highly desirable that the low pressure governer be of a design such that the controlled pressure is substantially independent of changes in applied pressure and demanded flow rates. Furthermore, since this governer must also pass the oil through a fine restriction in order to reduce the pressure, it should also automatically clear itself of any silting.

In a pneumatic piston and cylinder assembly incorporating hydraulic damping, the hydraulic piston has a piston rod on one side and not on the other and therefore a hydraulic fluid reservoir must be available to accept the difference in volume on the retraction stroke and to return it on the extension stroke. In order that the hydraulic fluid from the reservoir may be returned to the cylinder, the reservoir must be pressurised, for example by a piston with spring loading or by the application of external pressure such as a compressed air supply. Since this reservoir pressure is present as a back pressure on the downstream side of the control orifice, it can be used to significantly reduce the pressure drop across the control orifice thus assisting in maintaining low and consistent flow rates within the hydraulic circuit.

From one aspect, therefore, the present invention provides a method for controlling the rate of flow of hydraulic fluid in a high pressure hydraulic fluid circuit in which hydraulic fluid under high pressure is caused to pass through a variable flow control orifice to a hydraulic fluid reservoir contained in the circuit, wherein the hydraulic fluid under pressure is first caused to pass through a low pressure governer whereby the pressure drop across the said flow control orifice is reduced to a substantially constant low pressure enabling more accurate control of the rate of flow of fluid through said orifice.

From another aspect the invention provides a pneumatic piston and cylinder assembly including means for controlling the ram speed of the piston wherein said means comprises a hydraulic piston and cylinder assembly the hydraulic piston being driven by the operation of the pneumatic piston causing hydraulic fluid to be displaced from one side of the said hydraulic piston to the other side thereof via an interconnecting hydraulic circuit, said hydraulic circuit including flow controlling means for controlling the rate of flow of hydraulic fluid therein whereby the ram speed of the pneumatic piston is controlled, said flow controlling means including in said hydraulic circuit a variable flow control orifice and a low pressure governer located upstream of said orifice, said hydraulic circuit further including a hydraulic fluid reservoir located downstream of said variable flow orifice, which reservoir is maintained under constant pressure.

The low pressure governer may comprise a chamber having an inlet and outlet for the hydraulic fluid and including a movable wall connected to means for controlling the flow of fluid into the said chamber in response to a movement of said wall resulting from an increase in hydraulic pressure on the outlet side of said chamber.

The above mentioned chamber may be formed from a cylinder incorporating a piston and associated piston rod movable therein, said piston and piston rod having coaxial passageways extending therethrough, the free end of the piston rod forming one valve seat in a valve means having two co-operating valve seats for controlling the flow of hydraulic fluid into said cylinder said free end being urged away from the co-operating valve seat by resilient means acting against said piston.

An apparatus employing one embodiment of the invention will now be described by way of example only with reference to the accompanying drawing which is a diagrammatic cross-sectional view through a portion of the pneumatic cylinder assembly and hydraulic flow control valve assembly according to the present invention.

A pneumatic cylinder 1 has a piston 2 which slides within cylinder 1 and is sealed by means of seal 3. The piston 2 is carried on a piston rod 4 which is free to slide within the end piece of the assembly (not shown). One end of the assembly is sealed by a closure block 8.

A hydraulic damping cylinder assembly is provided within cylinder 1, the cylinder 30 being formed within the pneumatic piston rod 4. A piston 5 including a non-return valve 5(*a*) is carried by the hydraulic piston rod 6 and slides within the cylinder 30 and is sealed against the cylnder 30 by means not shown.

Piston 2 is sealed against rod 6 by means of the sealing ring 7.

The right hand end of the cylinder assembly 1 is closed by closure means 8 in which one end of the piston rod 6 is secured. A hydraulic fluid bore 16 runs the length of the piston rod 6 from an inlet 33 on the right hand side of piston 5 to a chamber 32 in the closure block 8.

A passageway 17 connects chamber 32 with a pressure governer generally indicated at 18, via inlet 19.

A hydraulic bore passes the length of rod 6 from an outlet 34 positioned at the front of the piston rod and to the left of piston 5 the other end communicating with an annular passageway 10, contained in closure block 8, which is interconnected via passageway 11 with the outlet side of a flow control valve 12.

The flow control valve 12 comprises a conical valve seat 13 with which co-operates a needle valve 14 adjustable by means of the knurled knob 15.

Pressure governer 18 comprises a cylindrical chamber 35 which carries a hollow piston 22 having an end face 27 and which is sealed against the cylinder 35 by sealing ring 23. The associated piston rod 36 is freely movable within the annular ring 24 against which it is sealed by a rubber ring (not shown). The piston 22 and piston rod 36 contains an axial hollow space 37 running the full length thereof, the right hand end of the passageway 37 communicating with the space 28 between the end face 27 of the piston 22 and the end wall of the cylinder 35. Outlet 20 communicates with space 28 and, via the passage 21, with the inlet side of the flow control valve 12. The opposite end of the axial passageway 37 communicates with inlet 19 via the annular space 38. A rubber seal 26 is fixed to the end wall of the cylinder 35 opposite the free end of the piston rod 36. A coil spring 25 is positioned between the annular ring 24 carrying the piston rod 36 and piston 22 to normally maintain a gap 39 between the free end of the piston rod 36 and the seal 26.

In operation air is forced into the space 31 in cylinder 1 by means not shown and causes piston 2 and associated piston rod 4 to move to the left. Hydraulic fluid on the right hand of piston 5 is then forced into unit 33 and through passageway 16 in piston rod 6 into the space 32 and then via passageway 17 and inlet 19 into the pressure governer 18. The hydraulic fluid flows through passageway 37 in piston rod 36 and piston 22 into space 28 and out of pressure governer via outlet 20 and via passageway 21 into the inlet side of the flow control valve 12.

Because its end area is very small, the force applied to the free end of piston rod 36 by the high pressure at inlet 19 is small. Consequently, the pressure increasing in the space 28 builds up the force on face 27 of piston 22, until it overcomes the opposing force of the spring 25, thereby forcing the piston 22 and piston rod 36 to the left until the free end of piston rod 36 contacts the seal 26 and halts the flow of hydraulic fluid. The controlled pressure in the space 28 and at the outlet 20 of the pressure governer is therefore determined by the force of coil spring 25. In practice, the piston 22 and associated rod 36 will normally take up a position within cylinder 35 which will vary according to any changes in pressure on either the input or output sides of the governer 18 to give a stable output pressure. In this condition, the bulk of the hydraulic pressure available in the hydraulic circuit is dropped across the narrow space between the free end of piston rod 36 and the seal 26, leaving only the low controlled output pressure (typically 7 kg/sq cm) to be dropped across the flow control valve 12. Should silting occur at the narrow space at the free end of piston rod 36, the pressure in the outlet space 28 must fall, causing the spring 25 to move the piston 22 and piston rod 36 to the right, increasing the gap at the free end of piston rod 36 and automatically clearing the silting.

In this apparatus the hydraulic fluid reservoir 40 is formed by the chamber in the cylinder 30 on the left hand side of piston 5 and is pressurised by means of a spring loaded piston 42 located at the end of the said chamber as described in British Pat. No. 1,320,335.

In an apparatus as described above if the pressure in the hydraulic fluid reservoir is maintained from a 7 kg/sq cm air supply through a pressure regulator, the back pressure in the hydraulic circuit may be varied from 1 to 6 kg/sq cm. In these circumstances the highest pressure across the flow control valve may be only 6 kg per sq cm and it can be reduced to as low as 1 kg per sq cm by raising the reservoir pressure. Flow rates through the flow control orifice can be reduced to as low as 0.05 ml per sec. without the difficulties experienced as a result of silting. The corresponding feed rate of the pneumatic ram is about 0.005 cm per second.

Since the flow rate, at a given setting of the flow control valve and at a given reservoir pressure, is determined by the output pressure of the low pressure governer, for all practical purposes the speed of the pneumatic piston is unaffected by fluctuations in air supply or variations in the applied load when, for example, a cutting tool is traversed over a work piece requiring varying depths of metal to be removed or when the cutting capability of the tool deteriorates.

The low pressure governer hereinbefore described also acts as a non-return valve. Thus when it is required to control the speed of the extension and retraction strokes in a double acting pneumatic piston and cylinder assembly, it is necessary to incorporate, in the hydraulic circuit, a second low pressure governer in series with and acting in the opposite sense to the first said low pressure governer. Such an assembly may usefully be employed to control the speed of cutting tools at the front and rear toolpost of a capitan cross slide.

I claim:

1. A system for controlling the ram speed of a pneumatic piston in a pneumatic piston and cylinder assembly comprising a hydraulic circuit which includes a hydraulic piston and cylinder assembly and a fluid reservoir, said hydraulic piston being responsive to the operation of said pneumatic piston causing hydraulic fluid to be displaced from one side of said hydraulic piston to the other side via said hydraulic circuit, said circuit further including flow controlling means for controlling the rate of flow of hydraulic fluid to said reservoir whereby the ram speed of said pneumatic piston is controlled, said flow controlling means comprising a variable flow control orifice and a low pressure governer located upstream of said orifice, means for maintaining said fluid reservoir under constant pressure, said low pressure governer including a generally cylindrical chamber having an inlet and an outlet for hydraulic fluid and including a wall movable in response to an increase in hydraulic pressure on the outlet side of said chamber, said wall comprising a piston and associated piston rod having a free end and movable in said cylindrical chamber, said piston and piston rod having coaxial passageways formed therethrough, said free end of said piston rod forming one valve member of a valve which includes two cooperating valve members for controlling the flow of hydraulic fluid into said cylindrical chamber, and resilient means acting against said piston normally urging said free end away from said cooperating valve member.

2. A system for controlling the ram speed of a pneumatic piston in a pneumatic piston and cylinder assembly as defined in claim 1 wherein said variable flow control orifice comprises a needle valve.

3. A system for controlling the ram speed of a pneumatic piston in a pneumatic piston and cylinder assembly comprising a pneumatic cylinder, a pneumatic piston and pneumatic piston rod slidable therein; a hydraulic circuit including a fluid reservoir and a hydraulic cylinder assembly interconnected with said pneumatic cylinder assembly, said hydraulic cylinder assembly being disposed within said pneumatic piston rod and including a hydraulic piston and piston rod slidable therein, said hydraulic piston providing on opposite sides thereof, first and second chambers within said hydraulic cylinder; said hydraulic circuit interconnecting said first and second chambers in the hydraulic cylinder; a variable flow control valve located in said hydraulic circuit between said first and second chambers; and a low pressure governer located in said hydraulic circuit in series with said flow control valve and one of said first and second chambers in said hydraulic cylinder; said low pressure governer comprising a cylindrical chamber having an inlet and outlet for the hydraulic fluid and including a control piston and associated piston rod having a free end and being reciprocable therein in response to variations in hydraulic pressure on the outlet side of said cylindrical chamber, continuous coaxial passageways being formed through said control piston and associated piston rod, said free end of said associated piston rod forming a valve member in a valve which includes two cooperating valve members for controlling the flow of hydraulic fluid into said cylindrical chamber and resilient means acting against said piston to urge said free end away from said cooperating valve member.

* * * * *